US005091023A

United States Patent [19]

Saeki et al.

[11] Patent Number: 5,091,023

[45] Date of Patent: Feb. 25, 1992

[54] COMPOSITION AND PROCESS FOR CHROMATING GALVANIZED STEEL AND LIKE MATERIALS

[75] Inventors: Kenshi Saeki, Okayama; Noriaki Yoshitake, Kanagawa, both of Japan

[73] Assignee: Henkel Corporation, Ambler, Pa.

[21] Appl. No.: 589,146

[22] Filed: Sep. 27, 1990

[30] Foreign Application Priority Data

Sep. 27, 1989 [JP] Japan ..... 1-251165

[51] Int. Cl.[5] ..... C23C 22/48

[52] U.S. Cl. ..... 148/247; 148/258; 148/267; 106/14.12

[58] Field of Search ..... 148/258, 247

[56] References Cited

U.S. PATENT DOCUMENTS 4,749,418 6/1988 Saeki et al. ..... 148/258

FOREIGN PATENT DOCUMENTS 0214571 8/1986 European Pat. Off. .
0249206 6/1987 European Pat. Off. .
0348890 1/1990 European Pat. Off. .
0391442 10/1990 European Pat. Off. .

*Primary Examiner*—Mark L. Bell
*Assistant Examiner*—Margaret V. Einsmann
*Attorney, Agent, or Firm*—Ernest G. Szoke; Wayne C. Jaeschke; Norvell E. Wisdom, Jr.

[57] ABSTRACT

The resistance of chromated zinc surfaced steel objects, particularly plates and sheets, to extraction of hexavalent chromium by alkaline degreasing solutions used on the chromated objects, can be substantially increased by utilizing an aqueous acidic liquid chromating composition containing (A) about 9.6 to about 96 g/L, expressed as its stoichiometric equivalent as chromic acid, of total chromium; (B) about 2 to about 35 g/L of trivalent chromium ions; (C) about 1 to about 128 g/L of phosphate ions; and (D) about 0.3 to about 4 g/L of fluorozirconate ions, with the chromium ratio in the aqueous acidic liquid composition being about 0.41 to about 0.70, the chromic acid/fluorozirconate weight ratio being about 10 to about 40, and the $PO_4/Cr^{+3}$ ratio being greater than about 0.03, greater than or equal to about {(9.2) (the chromium ratio)−4.0}, and less than or equal to about {(9.2) (the chromium ratio)−1.2}. . . The corrosion resistance of the coatings formed can be further improved if the chromating composition also contains about 0.1 to about 200 g/L of dispersed silica.

4 Claims, 3 Drawing Sheets

COMPOSITION AND PROCESS FOR CHROMATING GALVANIZED STEEL AND LIKE MATERIALS

BACKGROUND OF THE INVENTION

1. Field of the Invention

This invention relates to a process for chromating zinc surfaced steel objects to improve the resistance of the chromate coating formed to leaching by conventional aqueous based degreasing compositions, and to chromating solutions useful for such a process. The invention is applicable, for example, to all varieties of electroplated and/or dip coated forms of galvanized steel or zinc alloy coated steel, when the surface coating layer is metallic and is at least half zinc by weight. The film formed over the zinc surface has chromic acid or chromate as its principal component. This invention is particularly applicable to sheets and other flat zinc surfaced objects intended for later shaping into articles for ultimate use.

2. Statement of Related Art

It is known that the pre-painting and post-painting corrosion resistance of zinc surfaced steel objects may be improved by the formation of a chromate film on the objects, resulting from application to and drying on the sur faces of the objects of an acidic aqueous solution having chromic acid or chromate as its principal component. The chromium add-on in the chromate film formed on such a surface is generally from 5 to 200 milligrams per square meter ("$mg/m^2$"), and the object is normally dried at temperatures of 60 to 150 degrees Centigrade. Steel sheet carrying the chromate film generated by such a treatment is then normally subjected to cutting and/or forming operations and subsequently painted after such steps as degreasing, rinsing, and the like.

With chromate films obtained by the methods now conventional in the art, part of the chromate film elutes into the degreasing solution during a conventional degreasing step, and this compromises the performance quality of the film. In addition, this eluting portion of the prior art chromate films is predominantly hexavalent chromium, and its contamination of the degreasing solution is disadvantageous because of the risk of environmental pollution.

One means for inhibiting this chromium elution is to increase the trivalent chromium content in the chromate coating solution. However, because a chromate coating solution can easily gel as the chromate coating process progresses, as a result of build up in the coating solution of eluted zinc and trivalent chromium produced by reduction, there are practical limitations on the trivalent chromium content that can be produced in the films, without causing instability of the chromate coating solutions.

Accordingly, the prior chromate coating solutions suffer from problems in terms of avoiding environmental pollution and/or coating solution stability.

DESCRIPTION OF THE INVENTION

Except in the claims and the operating examples, or where otherwise expressly indicated, all numbers in this description indicating amounts of material or conditions of reaction and/or use are to be understood as modified by the word "about" in describing the broadest scope of the invention. Practice within the exact numerical limits stated is generally preferred.

SUMMARY OF THE INVENTION

As a concrete means for solving the problems described above for the prior art, the present invention utilizes a chromate coating solution for zinc surfaced steel objects, particularly sheet. The chromate coating solution is an acidic aqueous solution and comprises, or preferably consists essentially of, water and:

(A) from 9.6 to 96 grams per liter ("g/L"), expressed as its stoichiometric equivalent as chromic acid, of total chromium;

(B) from 2 to 35 g/L of trivalent chromium ions;

(C) from 1 to 128 g/L of phosphate ions; and (D) from 0.3 to 4 g/L of fluorozirconate ions.

In this specification of the composition, and in the additional specifications of the solution content given below, phosphoric acid itself and any anions produced by the partial ionization of phosphoric acid are considered as their stoichiometric equivalent as phosphate ions.

In addition to the compositional ranges given above, a chromate coating solution according to this invention conforms to the following conditions: (i) the ratio by weight of trivalent chromium ions to total chromium atoms in the solution, briefly denoted hereinafter as the "chromium ratio", is in the range from 0.41 to 0.70, or preferably in the range from 0.50 to 0.60; (ii) the ratio by weight of the total chromium content of the solution, expressed as its stoichiometric equivalent as chromic acid, to the fluorozirconate ion content, briefly denoted hereinafter as the "chromic acid/fluorozirconate ratio" or "$CrO_3/ZrF_6$", is from 10 to 40; and (iii) the ratio by weight of the phosphate ion content of the solution to the trivalent chromium ion content of the solution, briefly denoted hereinafter as the "phosphate/Cr(III) ratio" or "$PO_4^{-3}/Cr^{+3}$", is greater than 0.03, is greater than or equal to {(9.2)(the chromium ratio)−4.0}, and is less than or equal to {(9.2)(the chromium ratio)−1.2}.

DETAILED DESCRIPTION OF THE INVENTION AND OF THE PREFERRED EMBODIMENTS

Figure 1:
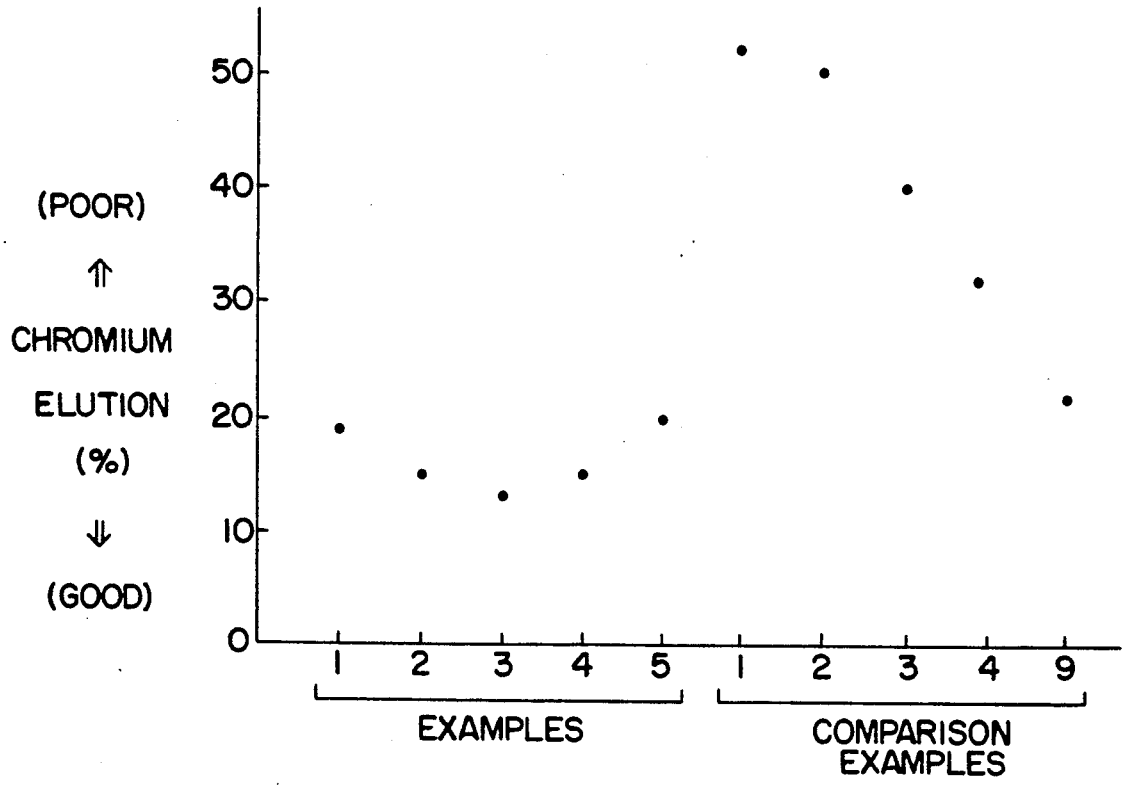
FIG. 1 is a graph showing chromate elution due to alkaline degreasing for the chromate coating solutions in Examples 1 to 5 of the present invention and Comparison Examples 1 to 9.

The chromate coating solution composition as specified above inhibits chromium elution from the chromate film during subsequent degreasing of the chromate coated surface, while achieving adequate stability of the chromate coating solution against gelation.

Furthermore, the addition of silica at 0.1 to 200 g/L to a chromate coating solution within the compositional conditions noted above also results in the formation of a highly corrosion resistant chromate film on the surface of zinc surfaced steel objects.

The chromic acid in the chromate coating solution of the present invention is preferably obtained by the addition of chromic anhydride (i.e., $CrO_3$), while the trivalent chromium ion can be added directly or, preferably, may be obtained by converting part of the hexavalent chromium into trivalent chromium by the addition of a reductant such as tannic acid, starch, alcohol, hydrazine, sucrose, and the like. The phosphate ions may be added in the form of orthophosphoric acid, ammonium phosphate, and the like. The hexafluorozirconate IV ion (i.e., $ZrF_6^{-2}$) may be added as, e.g., $(NH_4)_2ZrF_6$, $H_2ZrF_6$ and the like. The silica, if used, may be added directly in the form of finely divided and suspended solid silica, available commercially or otherwise from known wet method or dry method processes for making finely divided silica.

The range for the chromium ratio in a chromating solution according to this invention is 0.41 to 0.70. The chromate film formed from solutions with values below 0.41 suffers from substantial chromium elution during water rinsing, hot-water rinsing, or alkaline degreasing. On the other hand, the film formed has a reduced corrosion resistance when formed from solutions with chromium ratio values in excess of 0.70. At a chromium ratio within the range of 0.41 to 0.70, the chromate film formed on the surface of zinc surfaced steel sheet is uniform and is only very slightly susceptible to elution.

The phosphate ion and fluorozirconate ion are added in order to maintain the stability (by inhibiting gelation) of the chromate coating solution. The addition of phosphate ion at 1 to 128 g/L affords good stability without gelation, even for chromate coating solutions with a chromium ratio of 0.70. The chromate coating solution will usually gel if it contains less than 1 g/L phosphate ion or if the phosphate/Cr(III) ratio is less than 0.03 or is less than {(9.2)(the chromium ratio)−4.0}. With phosphate concentrations in excess of 128 g/L, or with a phosphate/Cr(III) ratio greater than {(9.2)(the chromium ratio)−1.2), the chromate coating solution is very stable, but the chromate film obtained will contain large amounts of chromium phosphate and usually will not have a satisfactory corrosion resistance.

The stability of the chromate coating solution is improved by the addition of the fluorozirconate ion, and this component also advantageously etches the surface of the substrate to be chromated, while at the same time converting the metal ions dissolved during etching into a complex. The result is that a firmly adherent chromate film can be obtained over long periods of use of the same chromating solution. There is little benefit from the fluorozirconate ion at concentrations below 0.3 g/L. On the other hand, at concentrations in excess of 4 g/L, the surface of the substrate to be chromated is etched excessively and zinc is dissolved rapidly into the chromate coating solution. This shortens the useful life of the chromate coating solution. The chromic acid/fluorozirconate ion weight ratio in the chromate coating solution should fall within the range of 10 to 40. At below 10 or in excess of 40, neither a firmly adherent chromate film nor a highly stable chromate coating solution can usually be obtained.

The presence of silica at 0.1 to 200 g/L in the chromate coating solution of the present invention improves the corrosion resistance of the chromate film coated product. Almost no effect from silica addition is observed at below 0.1 g/L, while exceeding 200 g/L leads to an excessive film coating weight and a poorer adherence by the chromate film. Considering the properties of the chromate film, preferred silica additions will give a chromic acid/silica weight ratio of 10:1 to 1:2.

With regard to use of the chromate coating solution of the present invention, the preferred process steps are generally degreasing, then a water rinse, then chromate coating, and finally drying. Preferably there should be no rinsing between chromate coating and drying. The chromate coating solution is preferably used at room temperature to 50 degrees Centigrade, and may be applied by roll coating, spraying, immersion, or any other convenient method of making adequate contact between the surface to be chromated and the chromating solution. Immediately after application, excess coating may be removed by any convenient method, such as passing between rolls or the like. The chromate coating solution is preferably applied at a coating weight of 10 to 200 mg/m$^2$ and more preferably 15 to 100 mg/m$^2$, measured as chromium on the surface area coated. The chromate coating solution removed by, for example, a passage between rolls, may be collected and recycled to the solution coating stage.

Zinc passes into the chromate coating solution as use of a chromate coating solution according to this invention continues, and the properties of the chromate film obtained can be substantially affected by the balance between this zinc dissolution and the quantity of solution taken up by the zinc surfaced steel sheet. Some means known per se in the art for controlling the quantity of zinc in the coating solution should preferably be implemented during prolonged use of a process according to this invention. For example, withdrawing and discarding a constant volume fraction of the bath and replacing the withdrawn volume with freshly made solution during prolonged use, or passing the solution periodically through an ion exchanger to remove zinc, may be used.

The practice of the invention may be further appreciated by consideration of the following working examples and comparison examples.

EXAMPLES

The present invention is illustrated in the following Examples 1 to 5 and contrasted with Comparison Examples 1 to 9. The composition and stability of each chromate coating solution are reported in Table 1. These solutions were prepared by dissolving the amount of $CrO_3$ shown in the top line, together with the orthophosphoric acid and fluorozirconic acid required to give the amounts of phosphate ion and $ZrF_6^{-2}$ shown respectively. The amount of $Cr^{+3}$ shown was then generated in situ by reduction with methanol. Thus the concentration shown for $CrO_3$ in Table 1 is actually the stoichiometric equivalent as $CrO_3$ of the total chromium atom content of the solution as already discussed above.

A commercial oiled electrogalvanized (zinc quantity=20 g/m$^2$) steel sheet was subjected to the following treatments in the order given: alkaline degreasing, water rinse, roll squeegee, roll coating of the chromate coating solution (at room temperature), and drying (maximum sheet temperature reached was 70 degrees Centigrade). The chromium add-on for the chromate films obtained was 60 mg/m$^2$.

TABLE 1

Compositions of the Chromate Coating Solutions and Stability of the Chromate Coating Solutions

| chromate coating solutions | | Examples 1 | 2 | 3 | 4 | 5 | Comparison Examples 1 | 2 | 3 | 4 | 5 | 6 | 7 | 8 | 9 |
|---|---|---|---|---|---|---|---|---|---|---|---|---|---|---|---|
| components in g/L (water) | $CrO_3$ | 57.7 | 57.7 | 57.7 | 57.7 | 57.7 | 57.7 | 57.7 | 57.7 | 57.7 | 57.7 | 57.7 | 57.7 | 57.7 | 57.7 |
| | $Cr^{3+}$ | 12.3 | 15.0 | 18.0 | 21.0 | 15.0 | — | 3.0 | 6.0 | 9.0 | 15.0 | 18.0 | 21.0 | 24.0 | 24.0 |
| | chromium ratio | 0.41 | 0.50 | 0.60 | 0.70 | 0.50 | 0 | 0.10 | 0.20 | 0.30 | 0.50 | 0.60 | 0.70 | 0.80 | 0.80 |
| | $PO_4^{3-}(H_3PO_4)$ | 6.5 | 12.5 | 37.8 | 76.7 | 12.5 | — | 6.5 | 6.5 | 6.5 | 6.5 | 12.5 | 37.8 | 76.7 | 131.5 |
| | $ZrF_6^{2-}(H_2ZrF_6)$ | 2.3 | 2.3 | 2.3 | 2.3 | 2.3 | — | 2.3 | 2.3 | 2.3 | 2.3 | 2.3 | 2.3 | 2.3 | 2.3 |
| | $CrO_3/ZrF_6^{2-}$ | 25/1 | 25/1 | 25/1 | 25/1 | 25/1 | — | 25/1 | 25/1 | 25/1 | 25/1 | 25/1 | 25/1 | 25/1 | 25/1 |
| | $PO_4^{3-}/Cr^{3+}$ | 0.53 | 0.83 | 2.10 | 3.65 | 0.83 | — | 2.17 | 1.08 | 0.72 | 0.43 | 0.69 | 1.80 | 3.20 | 5.48 |
| | $SiO_2$ (silica sol) | — | — | — | — | 60 | — | — | — | — | — | — | — | — | — |
| chromate coating solution stability | | + | + | + | + | + | + | + | + | + | × | × | × | × | + |

Figure 2:
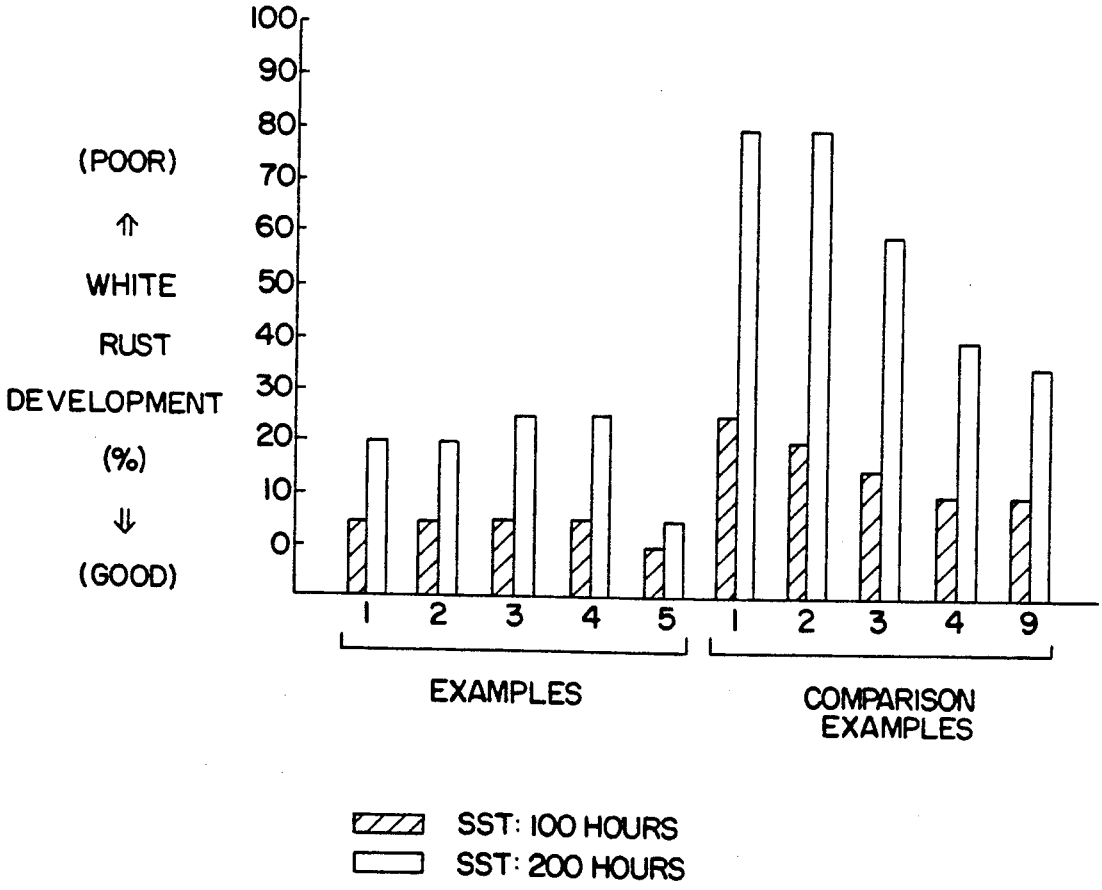
FIG. 2 is a graph which reports the corrosion resistance after alkaline degreasing for the same examples and comparison examples.
Figure 3:
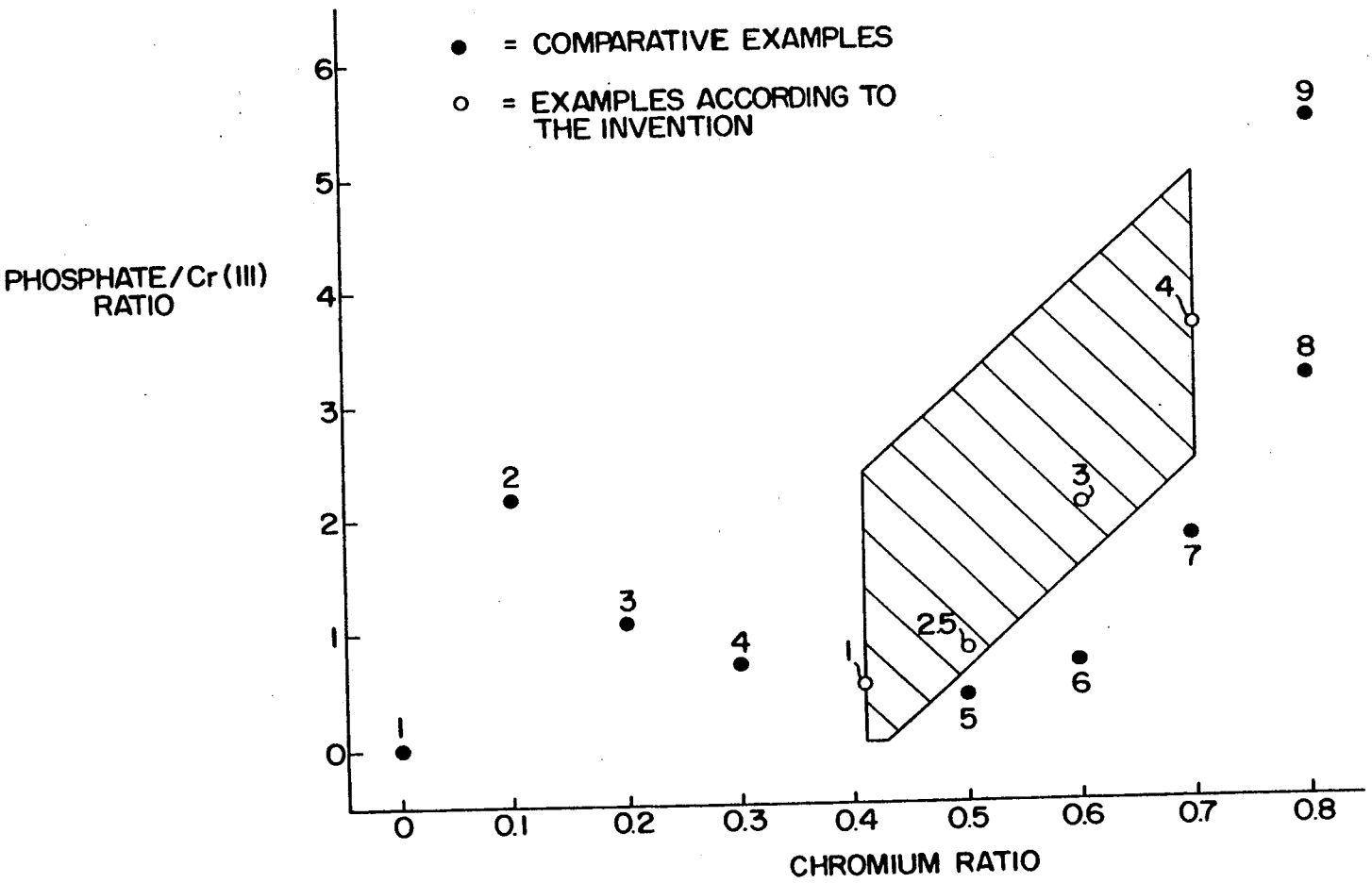
FIG. 3 shows by its shaded area the range of chromium ratios (on the horizontal axis) and phosphate/Cr(III) ratios (on the vertical axis) for which the solutions are stable against gelation, and shows the chromium ratios and the phosphate/Cr(III) ratios for the compositions of each of the examples and comparison examples.

The values in FIGS. 1 and 2 were determined by the following tests:

CHROMIUM ELUTION

The chromated samples were sprayed for 2 minutes at a spray pressure of 0.8 kilograms per square centimeter, using a 2% by weight solution in water, at a temperature of 60 degrees Centigrade, of a conventional commercial medium alkaline degreaser based on sodium phosphate and sodium silicate. This chromating was followed by a water rinse and drying. The chromium adhering on the steel sheet was measured before and after this spraying treatment, and the chromium elution is defined as $100(A_p-A_a)/A_p$, where $A_p$ is the areal density of chromium add-on prior to the spraying treatment and $A_a$ is the areal density of chromium after the spraying treatment.

CORROSION RESISTANCE

After alkaline degreasing of the chromate film as described above, the samples were tested in a conventional salt spray test. The area of white rust development (as a percent of the total area) was examined and recorded after 100 and 200 hours of salt spray exposure.

CHROMATE COATING SOLUTION STABILITY

After preparation of the chromate coating solution, its external appearance was inspected visually. The results are reported in Table 1: +=no abnormalities; x=gelation.

BENEFITS OF THE INVENTION

As has been explained above, a zinc surfaced steel product chromated according to this invention evidences a smaller amount of chromate elution than products treated with prior chromate coating solutions and thus substantially reduces environmental pollution. At the same time, a chromating solution composition according to this invention is relatively resistant to adverse effects from zinc dissolving into the solution during a fairly long time after being first made up, and can be continued in use much longer when subjected to continuous treatment to counter the buildup of zinc in the solution. Thus the chromating solutions according to this invention have excellent longterm stability.

In addition, a chromate film can be formed which evidences an even better corrosion resistance when the acidic aqueous solution of the present invention contains dispersed silica at a concentration of 0.1 to 200 g/L.

What is claimed is:

1. An aqueous acidic liquid composition of matter, consisting essentially of water and:

(A) from about 9.6 to about 96 g/L, expressed as its stoichiometric equivalent as chromic acid, of total chromium;

(B) from about 2 to about 35 g/L of trivalent chromium ions;

(C) from about 1 to about 128 g/L of phosphate ions; and (D) from about 0.3 to about 4 g/L of fluorozirconate ions; and, optionally, (E) from about 0.1 to about 200 g/L of dispersed silica, the chromium ratio, which is the ratio by weight of trivalent chromium ions to total chromium atoms, in said aqueous acidic liquid composition being from 0.41/1 to about 0.70/1, the chromic acid/fluorozirconate ratio in said aqueous acidic liquid composition being about 10/1 to about 40/1, and the phosphate/Cr(III) ratio in said aqueous acidic liquid composition being greater than about 0.03/1, greater than or equal to about {(9.2)(the chromium ratio)−4.0}/1, and less than or equal to about {(9.2)(the chromium ratio)−1.2}/1.

2. A composition according to claim 1, comprising at least about 0.1 g/L of dispersed silica.

3. A composition according to claim 2, wherein the chromium ratio in said aqueous acidic liquid composition is between about 0.50 and about 0.60.

4. A composition according to claim 1, wherein the chromium ratio in said aqueous acidic liquid composition is between about 0.50 and about 0.60.

* * * * *